US010082014B2

(12) United States Patent
Fielder, III et al.

(10) Patent No.: US 10,082,014 B2
(45) Date of Patent: Sep. 25, 2018

(54) APPARATUS AND METHOD FOR PREVENTING PARTICLE INTERFERENCE OF DOWNHOLE DEVICES

(71) Applicant: FORUM US, INC., Houston, TX (US)

(72) Inventors: Robert P. Fielder, III, Houston, TX (US); Kyle Meier, Houston, TX (US); Evan Sheline, Sugar Land, TX (US)

(73) Assignee: FORUM US, INC., Houston, TX (US)

( * ) Notice: Subject to any disclaimer, the term of this patent is extended or adjusted under 35 U.S.C. 154(b) by 0 days.

(21) Appl. No.: 15/589,115

(22) Filed: May 8, 2017

(65) Prior Publication Data

US 2017/0328190 A1 Nov. 16, 2017

Related U.S. Application Data

(60) Provisional application No. 62/334,174, filed on May 10, 2016.

(51) Int. Cl.

| | |
|---|---|
| ***E21B 43/38*** | (2006.01) |
| ***E21B 43/12*** | (2006.01) |
| ***E21B 34/08*** | (2006.01) |
| ***E21B 27/00*** | (2006.01) |
| *E21B 34/00* | (2006.01) |

(52) U.S. Cl.

CPC ..... *E21B 43/38* (2013.01); *E21B 27/00* (2013.01); *E21B 34/08* (2013.01); *E21B 43/128* (2013.01); *E21B 2034/002* (2013.01)

(58) Field of Classification Search

CPC ..... E21B 43/128; E21B 27/00; E21B 27/005; E21B 37/00; E21B 41/0078; E21B 43/121; F04D 7/02; F04D 29/708; F04F 5/10; B01D 21/0021; B01D 21/267

See application file for complete search history.

(56) References Cited

U.S. PATENT DOCUMENTS

| | | | | |
|---|---|---|---|---|
| 2,347,768 A * | 5/1944 | Crites | ..... | E21B 43/38 166/105.4 |
| 5,413,721 A * | 5/1995 | Schmitt | ..... | B01D 29/15 210/108 |
| 5,553,669 A * | 9/1996 | Trainer | ..... | B01D 29/114 166/105.1 |
| 5,662,167 A | 9/1997 | Patterson et al. | | |

(Continued)

OTHER PUBLICATIONS

The American Oil & Gas Reporter, "New Production Tech Averts Failures", Jan. 2016, 2 pgs.

(Continued)

*Primary Examiner* — Jennifer H Gay

(57) ABSTRACT

A device and method for inhibiting particle (e.g., sand) accumulation on down hole equipment, such as an ESP, particularly when the equipment is not in use. The device and methods permit the equipment to start and stop with fewer break downs and at greater efficiency. The device includes a central tubular section connecting the equipment to the production tubing string. The tubular section is surrounded by an annulus and a number of ports in the tubular section angled to allow fluid communication between the tubular section and the annulus during operation, but prevent particles from flowing from the annulus into the tubular section when not in use. A check valve between the tube and ESP assists in isolating the ESP from sand.

10 Claims, 9 Drawing Sheets

(56) References Cited

U.S. PATENT DOCUMENTS 6,189,617 B1 * 2/2001 Sorhus ..... E21B 27/00 166/162
7,195,070 B2 * 3/2007 Delaloye ..... E21B 37/06 166/304
7,331,397 B1 * 2/2008 Wagley ..... E21B 17/18 166/328
7,610,957 B2 * 11/2009 Davis ..... E21B 29/002 166/162
8,109,331 B2 * 2/2012 Lynde ..... E21B 37/00 166/105.3
8,210,251 B2 * 7/2012 Lynde ..... E21B 23/14 166/55.7
8,257,585 B2 * 9/2012 Davis ..... B01D 35/02 166/312
8,522,882 B2 * 9/2013 Rich ..... E21B 43/126 166/105.2
8,584,744 B2 * 11/2013 Soni ..... E21B 27/04 166/99
9,441,435 B2 9/2016 Leitch
9,657,554 B2 * 5/2017 Morton, Jr. ..... E21B 43/084
2006/0011345 A1 * 1/2006 Delaloye ..... E21B 37/06 166/304
2009/0200012 A1 * 8/2009 Davis ..... E21B 27/005 166/99
2010/0258289 A1 * 10/2010 Lynde ..... E21B 23/14 166/55.7
2010/0258296 A1 * 10/2010 Lynde ..... E21B 37/00 166/105.1
2010/0258297 A1 * 10/2010 Lynde ..... E21B 37/00 166/105.1
2011/0049025 A1 * 3/2011 Davis ..... B01D 35/02 210/109
2012/0061073 A1 * 3/2012 Soni ..... E21B 27/04 166/99
2012/0211237 A1 * 8/2012 Rich ..... E21B 43/126 166/369
2013/0032352 A1 * 2/2013 Raglin ..... E21B 43/121 166/369
2014/0014358 A1 * 1/2014 Leitch ..... E21B 27/005 166/369
2014/0284061 A1 9/2014 Leitch
2015/0047830 A1 * 2/2015 Morton ..... E21B 43/084 166/230
2017/0107798 A1 * 4/2017 Gourmelon ..... E21B 43/08

OTHER PUBLICATIONS

The American Oil & Gas Reporter, "Technology Solves Sanding Problems", Feb. 2016, 3 pgs.

* cited by examiner

APPARATUS AND METHOD FOR PREVENTING PARTICLE INTERFERENCE OF DOWNHOLE DEVICES

PRIORITY CLAIM

The present application claims priority to U.S. Provisional Application No. 62/334,174 filed May 10, 2016, which is incorporated by reference herein.

BACKGROUND OF THE INVENTION

1. Field of the Invention

This invention relates to systems and methods to prevent particle interference with downhole equipment, such as an electrical submersible pump (ESP).

2. Description of the Relevant Art

Management of sand in the well bore has long been an issue. Many oil and gas wells are in sand-producing intervals, such as sandstones. There are several forms of artificial lift of the production fluids, with the most common being the electrical submersible pump (ESP). In recent years, unconventional wells have gained wide spread acceptance and often involve horizontal production tubing, ESP's for lift, and multiple, highly fractured production intervals, often in shale or other unconsolidated formations.

In such highly fractured, horizontal wells, the use of proppants, such as sand, to maintain the frac efficiency has increased. That is, there is a trend to use even more proppant per lateral foot of wellbore. Many ESP pumps have been manufactured to operate on sand filled fluid without significant numbers of failure. However, ESP's are often stopped, both intentionally and unintentionally. For example, electric reliability and power fluctuations often stop ESP operation or the ESP is stopped for maintenance or production issues. "Sand, particles and proppants" are sometimes used interchangeably for simplicity herein.

When an ESP stops operating, the sand in the production fluid tends to settle in the production tubing. The sand settles on the ESP which not only induces component failures in the ESP, but also makes restart of the ESP difficult because the ESP must first clear substantial amounts of sand from the production tubing. Failure and replacement of an ESP is not only expensive because of the rework required in the well, but also because of the lost production time.

Several attempts have been made to prevent sand accumulation on ESP's particularly when the ESP is idle. See e.g., CN Pat. Pub. No. 1,955,438, PCT App. Pub. No. WO2007083192, U.S. Pat. No. 6,289,990, U.S. Pat. No. 7,048,057, U.S. Pat. No. 9,181,785 and U.S. Pat. No. 9,441,435 (incorporated by reference). However, each of these existing tool designs has limitations which lead to suboptimal performance, and many are unnecessarily complex and expensive. Thus, a need continues to exist for a tool design that will automatically and cost effectively prevent the accumulation of sand on an ESP, without redepositing the sand below the ESP, potentially preventing the restarting of the ESP or requiring other steps to purge the production tubing of accumulated sand.

SUMMARY OF THE INVENTION

Problems with ESP operation are addressed by the device and methods of the present invention which tend to prevent particle accumulation on the ESP when not in use and provide for more efficient operation. Therefore the reliability, efficiency, timeliness and the likelihood of a successful restart of an ESP is greatly increased. Generally, the device prevents particle interference with lifting equipment, such as an ESP, in a well bore having a production tubing string using a tube positioned between the lifting equipment and the surface and in fluid communication with the lifting equipment and the production tubing string. An annulus portion is defined around the tube, e.g. with a cylinder spaced from and surrounding the tube. The device includes a check valve proximate at least one end of the tube which operates to permit fluid flow from the lifting equipment to the surface, but prevents fluid flow from the tube to the lifting equipment. The device has a plurality of ports positioned in the wall of the tube which operate to permit fluid flow from the tube into the annulus during operation of the lifting equipment and operable to inhibit particles from entering the tube when the lifting equipment is not operating. Preferably, the ports are angled in the direction of the lifting equipment and can be more dense closest to the lifting equipment.

One method of the present invention operates to inhibit particle impediment to lifting equipment, such as an ESP, when not in use. Generally, the lifting equipment is positioned in the well bore downhole from the surface and operable to pump fluid through a production tubing string to the surface. A particle-excluding device is connected to the production tubing string between the lifting equipment and the surface, the device having a central tubular portion, a surrounding annulus portion, a plurality of spaced ports communicating between the tube and the annulus and a check valve between the ports and the lifting equipment. The lifting equipment is operated so that fluid flows through the check valve, ports, tubular portion and at least some of the annulus portion and into the production tubing. The method inhibits particles in the fluid from accumulating on the lifting equipment when the lifting equipment is not in use by trapping a substantial portion of particles in the annulus, whereby the ports inhibit particle flow into the tubing portion. The check valve prevents reverse fluid flow to the lifting equipment when not in use, and thus prevents the ESP from spinning backwards due to a reversal of the fluid flow.

BRIEF DESCRIPTION OF THE DRAWINGS

Other objects and advantages of the invention will become apparent upon reading the following detailed description and upon reference to the accompanying drawings.

DETAILED DESCRIPTION OF THE PREFERRED EMBODIMENTS

Figure 1:
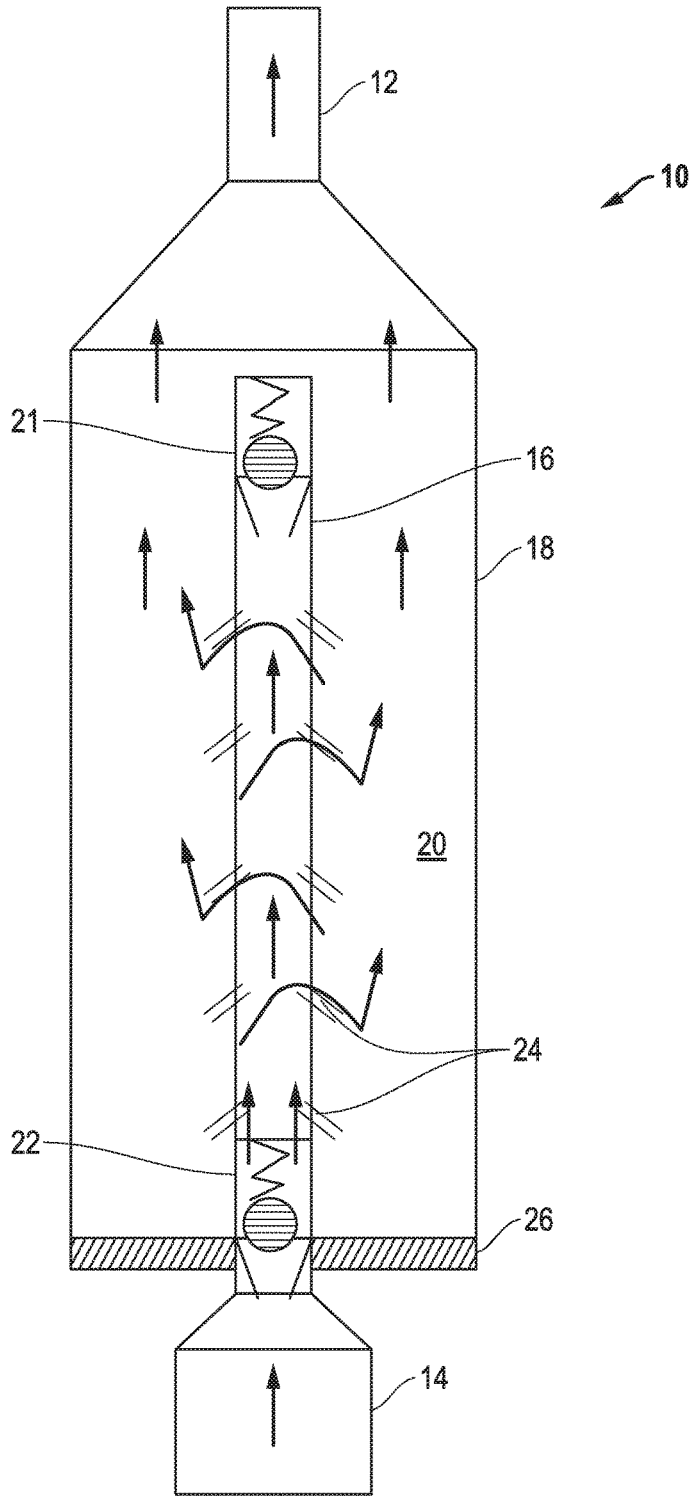
FIG. 1 is a schematic, sectional view of a first embodiment of a device in accordance with the present invention with the production fluid flowing normally.

Turning to the drawings, a first embodiment of a device 10 in accordance with the present invention is illustrated in FIGS. 1-5. The device 10 is inserted as part of the production tubing string with FIG. 1 showing production tubing 12 leading to the surface and ESP 14 located downhole adjacent to the device 10. It should be understood that the device 10 can be spaced from the ESP and in fact, multiple devices 10 can be used in the production tubing string. Further, while FIG. 1 appears as a conventional vertical orientation, the device 10 can also be used in horizontal wells. Additionally, while the usefulness of the device 10 is illustrated in this embodiment as protecting an ESP, other downhole devices can be similarly protected from particles such as sand or fracking proppants.

Figure 2:
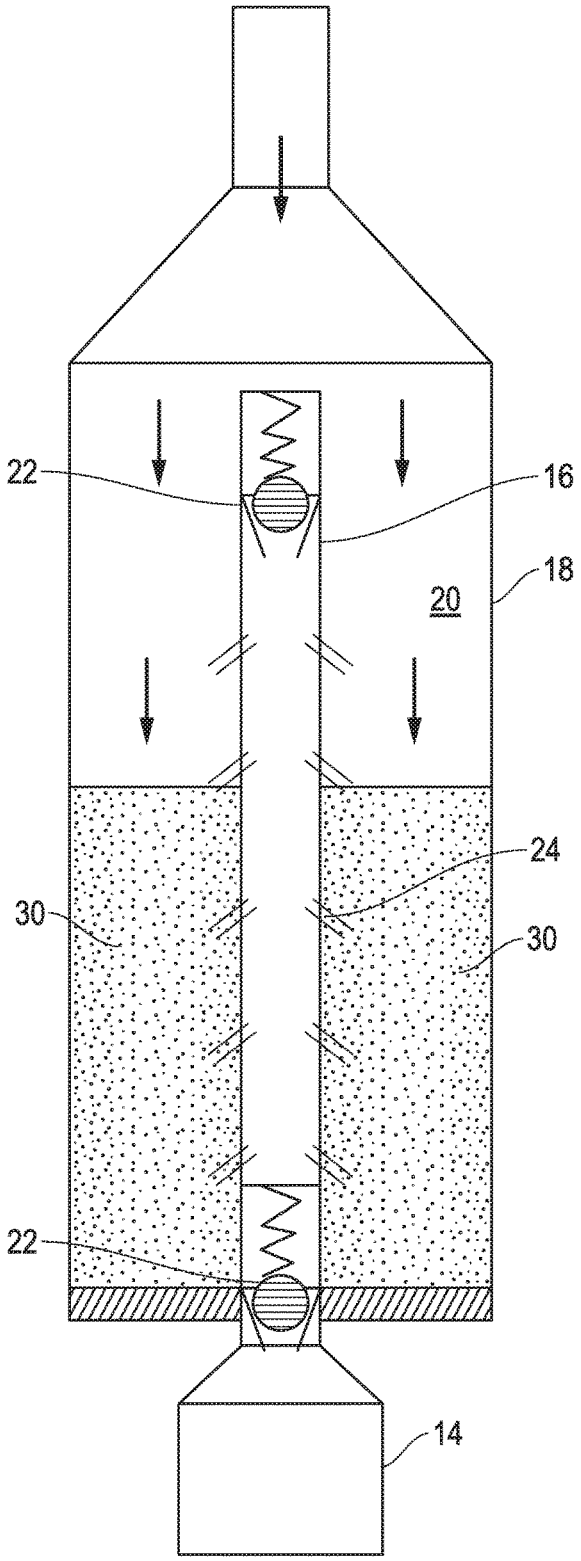
FIG. 2 is a sectional view of the device of FIG. 1 with the flow of the production fluid stopped.
Figure 3:
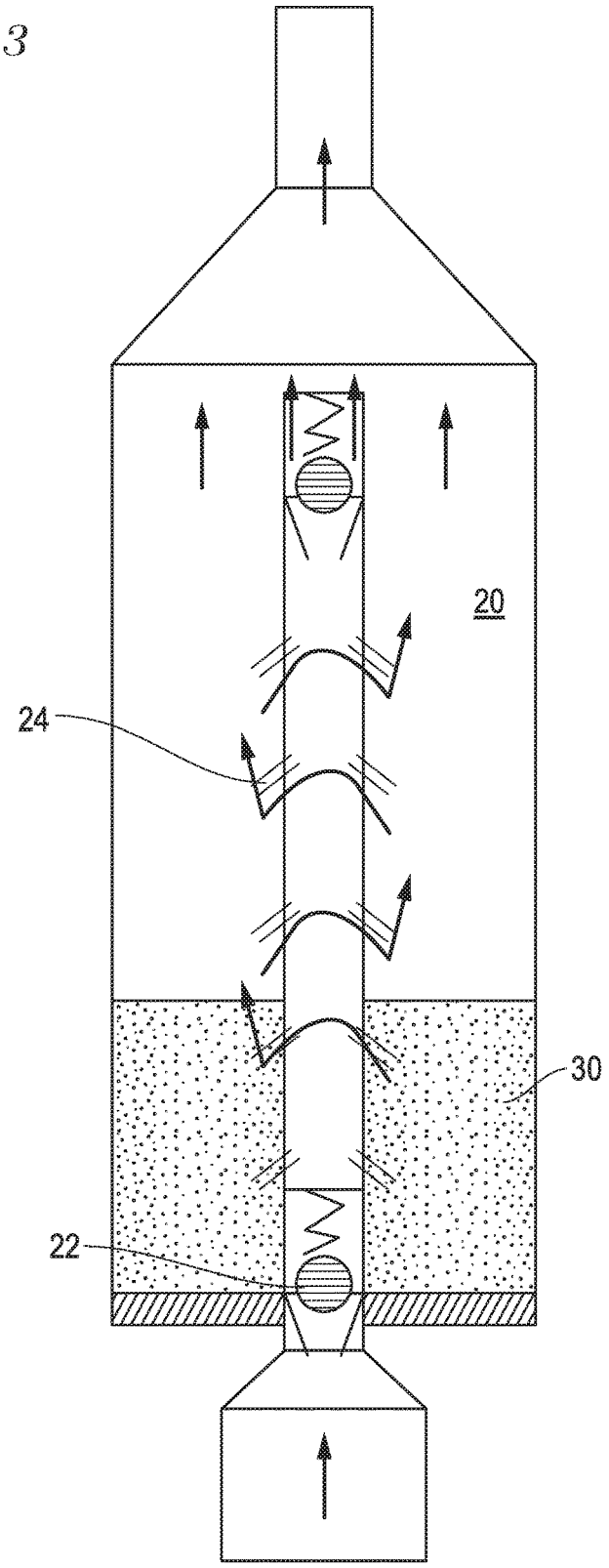
FIG. 3 is a sectional view of the device of FIG. 1 with the production fluid starting flow after having stopped.

Generally, the device 10 includes a central production tube 16 surrounded by an enlarged cylinder housing 18. Thus, the area between the tube 16 and the inner walls of the cylinder 18 define an annulus 20. At each end of the tube 16 is a check valve 21, 22. FIGS. 1-3 illustrate a ball check valve, but other types of check valves known in the art can be used, such as diaphragm check valve, swing check valve or tilting disc check valve, stop-check valve, lift-check valve, in-line check valve, duckbill valve, or pneumatic non-return valve. The check valve 21, 22 illustrated has a pre-tensioned spring to bias a ball into a seat in a closed position and designed to open at a particular pressure. The check valves 21, 22 of FIG. 1 are open. A number of ports 24 are arranged along the length of the tube 16 providing fluid communication between the production tube 16 and the annulus 20.

An end packer 26 is illustrated in FIG. 1 as defining the terminus for the cylinder 18. It should be understood, however, that any seals are acceptable, such as an O-ring bore seal. While the device 10 is illustrated as a discrete device inserted as part of the production tubing string, it can be appreciated that the cylinder 18 and annulus 20 could be defined by setting a packer at each end of a casing section to encompass the tube 16 and valves 21, 22.

During normal operation (FIG. 1) most of the production fluid flows from the ESP through tube 16, but at least part of the fluid within the tube 16 exits the tube 16 through the ports 24 into the annulus. The fluid streams from within the tube 16 and annulus 20 recombine in the region of the top of the tube 16 proximate check valve 21 to flow up the production tubing.

In FIGS. 2-5 the same components as FIG. 1 are generally illustrated at various stages of the well operation. In FIG. 2, the ESP is off and production fluid flow has ceased. Therefore, particles such as sand 30 settles downward in the annulus 20. The check valves 21 (if utilized), 22 are closed and movement of the sand entrained in the fluid is illustrated by the down arrows. Check valve 21 prevents particle flow into the tube 16. Particles 30 tends to build up in the annulus 20 near the lower check valve 22, but does not appreciably flow into the tube 16 through the ports 24; the design and orientation of the ports 24 prevent sand to flow into the tube 16.

In FIG. 3, the ESP 14 is turned on and there are no are no significant buildup of particles 30 on top of the ESP discharge, i.e. in the tube 16. Both check valves 21, 22 immediately open and production fluid flow through the tube 16 up the production tubing to the surface begins almost immediately. As shown in FIG. 3, a number of the uppermost ports 24 are not covered by particles 30 and some of the fluid in the tube 16 flows through the ports 24 into the annulus 20. The particles 30 cover some of the lower ports 24 (e.g., ports 24 near the lower check valve 22) and little fluid flow occurs through these lower ports 24. However, the density of the particles 30 in the fluid in the annulus decreases towards the surface, allowing some fluid flow through the ports 24 into the annulus. This allows the annulus to be self-clearing over time. That is, as the upper ports 24 become partially uncovered with sand, fluid flows from the tube 16 through the ports 24 into the annulus helping to clear the remaining sand.

Figure 4:
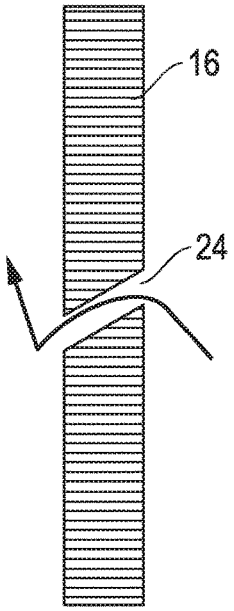
FIG. 4 is a sectional view of a detail of a port in the device of FIGS. 1-3 and FIGS. 6-9 showing normal production fluid flow.
Figure 5:
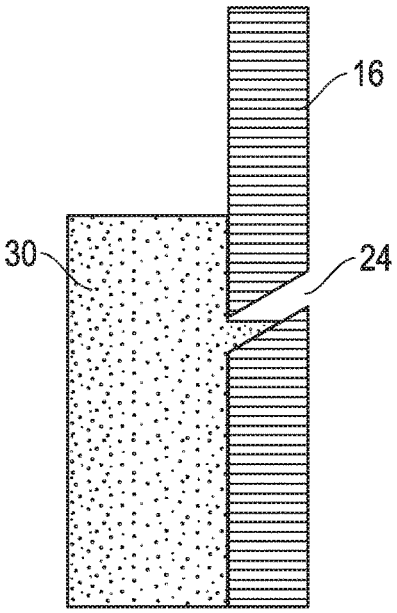
FIG. 5 is a sectional view of a detail of a port in the device of FIGS. 1-3 and FIGS. 6-9 showing production fluid flow stopped.

FIGS. 4 and 5 are cross sections of a port 24 through the wall of the tube 16. In FIG. 4, the ESP 14 is operating (e.g., as in FIG. 1) and fluid is flowing from the tube 16 through the port 24 into the annulus 20. The arrow in FIG. 4 illustrates the fluid flow direction. Each port 24 is downwardly angled (relative to the fluid flow directions in FIG. 1) so that fluid will flow from the tube to the annulus 20, but particles 30 will not easily flow from the annulus 20 into the tube 16. FIG. 5 illustrates this tendency of particles 30 to not flow from the annulus 20 into the tube 16 when the ESP is not operating, such as FIG. 2.

The "downward" angle of the port 24 is greater than perpendicular, but the optimum angle is dependent on the orientation of the device 10 (vertical vs. horizontal), the density of the sand 30 and the composition of the fluid. It is believed that about a 45' angle will work for most vertical applications, and preferably between 30-60'. The use of the angled ports 24 is believed advantageous over resistive mesh screens to prevent sand from entering the tube and hindering operation of the ESP 14. The design of ports 24 includes consideration not only of the angle, but also the diameter of the port 24. The design of the ports 24 also takes into consideration the wall thickness (weight) of the tube 16. In FIG. 5 a vertical (or near vertical) well is illustrated and the design of port 24 includes an angle in the direction opposite fluid flow and diameter of the port (24) such that particles cannot flow into the tube (16) as shown. The size of the ports can be much larger than mesh screens thus allowing more flow area to be achieved. The size of the ports may also be non-uniform and vary in size depending on desired flow characteristics. While the port cross-section is circular, other geometries are acceptable such as elongated slots or square cross-sections. The ports may be variable in size, variable spacing and variable densities.

While the device 10 is illustrated in the context of a vertical well bore in the figures, it will be understood that horizontal wells can benefit from the use of the device 10. In fact, horizontal wells make extensive use of proppants for fracking which is a prime contributor to particles in the production tubing which can settle onto an ESP and hinder operation. Additionally, while protection of ESP's is a prime use of the device 10, other downhole equipment can be protected from particle interference as well.

Figure 6:
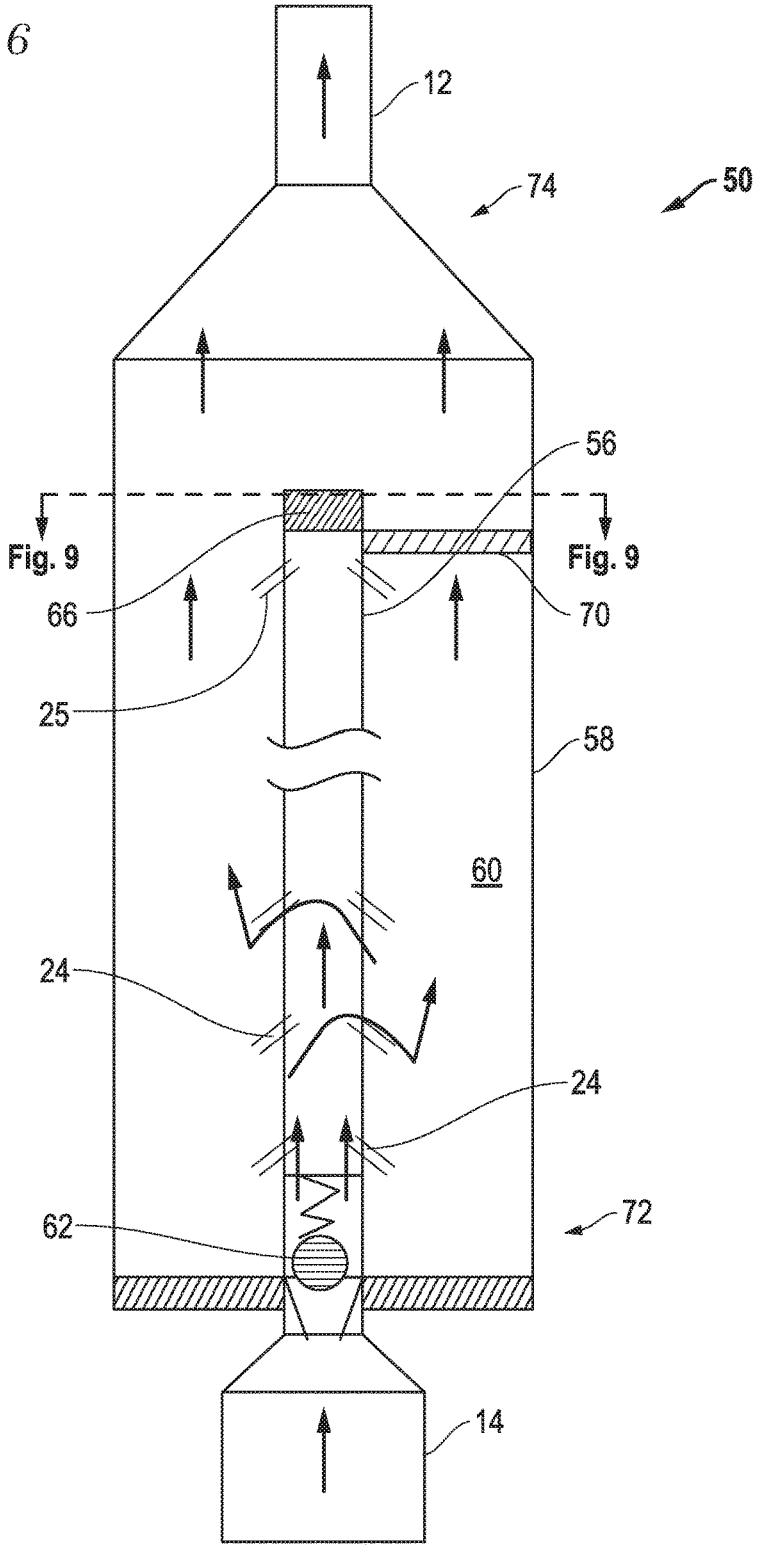
FIG. 6 is a schematic, sectional view of a second embodiment of a device in accordance with the present invention with the production fluid flowing normally from an ESP to the surface.

A second embodiment of a device 50 in accordance with the present invention is illustrated in FIGS. 6-9. The device 50 is inserted as part of the production tubing string with FIG. 6 showing production tubing 12 leading to the surface and ESP 14 located downhole adjacent to the device 50. It should be understood that the device 50 can be spaced from the ESP and in fact, multiple devices 50 can be used in the production tubing string. Further, while FIG. 6 appears as a conventional vertical orientation, the device 50 can also be used in horizontal wells. Additionally, while the usefulness of the device 50 is illustrated in this embodiment as protecting ESP 14, other downhole devices can be similarly protected from particles such as sand or fracking proppants.

Generally, the device 50 includes a central cylindrical tube 56 surrounded by an enlarged cylinder housing 58. Thus, the area between the tube 56 and the inner walls of the cylinder 18 define an annulus 60. At the distal end 72 of the tube 56, nearest the ESP 14, is a check valve 62. At the proximal end 74 of the tube 56, nearest the surface, is a cap 66. As with the first embodiment check valves known in the art can be used, such as ball type check valves, diaphragm check valve, swing check valve or tilting disc check valve, stop-check valve, lift-check valve, in-line check valve, duckbill valve, or pneumatic non-return valve. The cap 66 is fixed to prevent fluid flow to or from the tube 56 in the region of the cap 66. The check valve 62 of FIG. 6 is open. A number of ports 24 are arranged along the distal end 72 of the tube 56 providing fluid communication between the tube 56 and the annulus 60. A few ports 24 are provided near the proximal end 74 as seen in FIGS. 6-9. That is, the density of the ports 24 is greatest near the distal end 72.

An end packer 68 is illustrated in FIG. 6 as defining the terminus for the cylinder 18 near the distal end 72. It should be understood, however, that any seals are acceptable, such as an O-ring bore seal. One or more centralizers 70 are shown for maintaining the tube 56 central in the cylindrical housing 58. While the device 50 is illustrated as a discrete device inserted as part of the production tubing string, it can be appreciated that the cylinder 58 and annulus 60 could be defined by setting a packer at each end of a casing section to encompass the tube 56, cap 66 and valve 62.

During normal operation (FIG. 6) the production fluid flows from the ESP through tube 56, but all of the fluid within the tube 56 exits the tube 56 through the ports 24 into the annulus 60. The fluid stream from within the annulus 60 flows up the production tubing 12.

Figure 7:
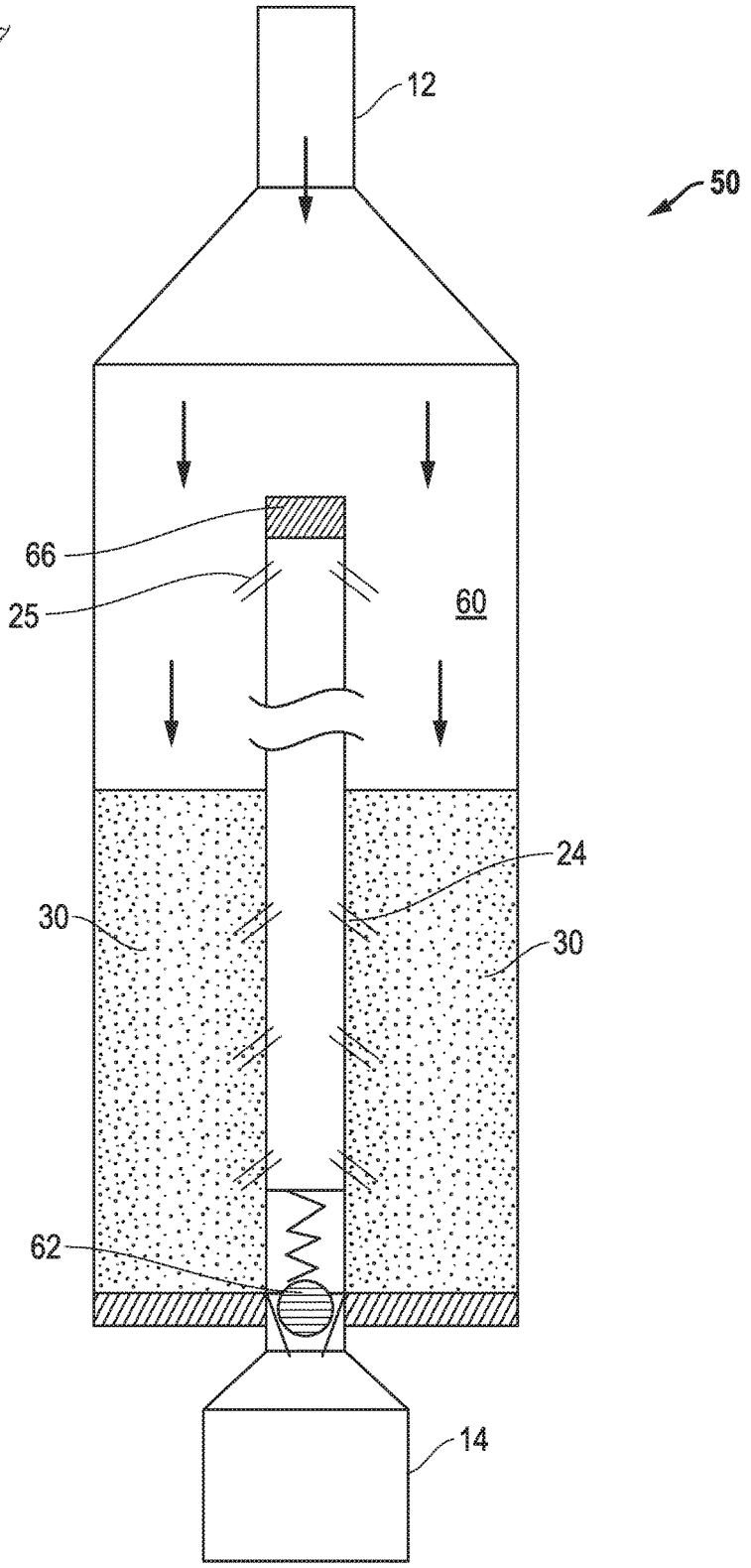
FIG. 7 is a sectional view of the device in FIG. 6 with the flow of the production fluid stopped.
Figure 8:
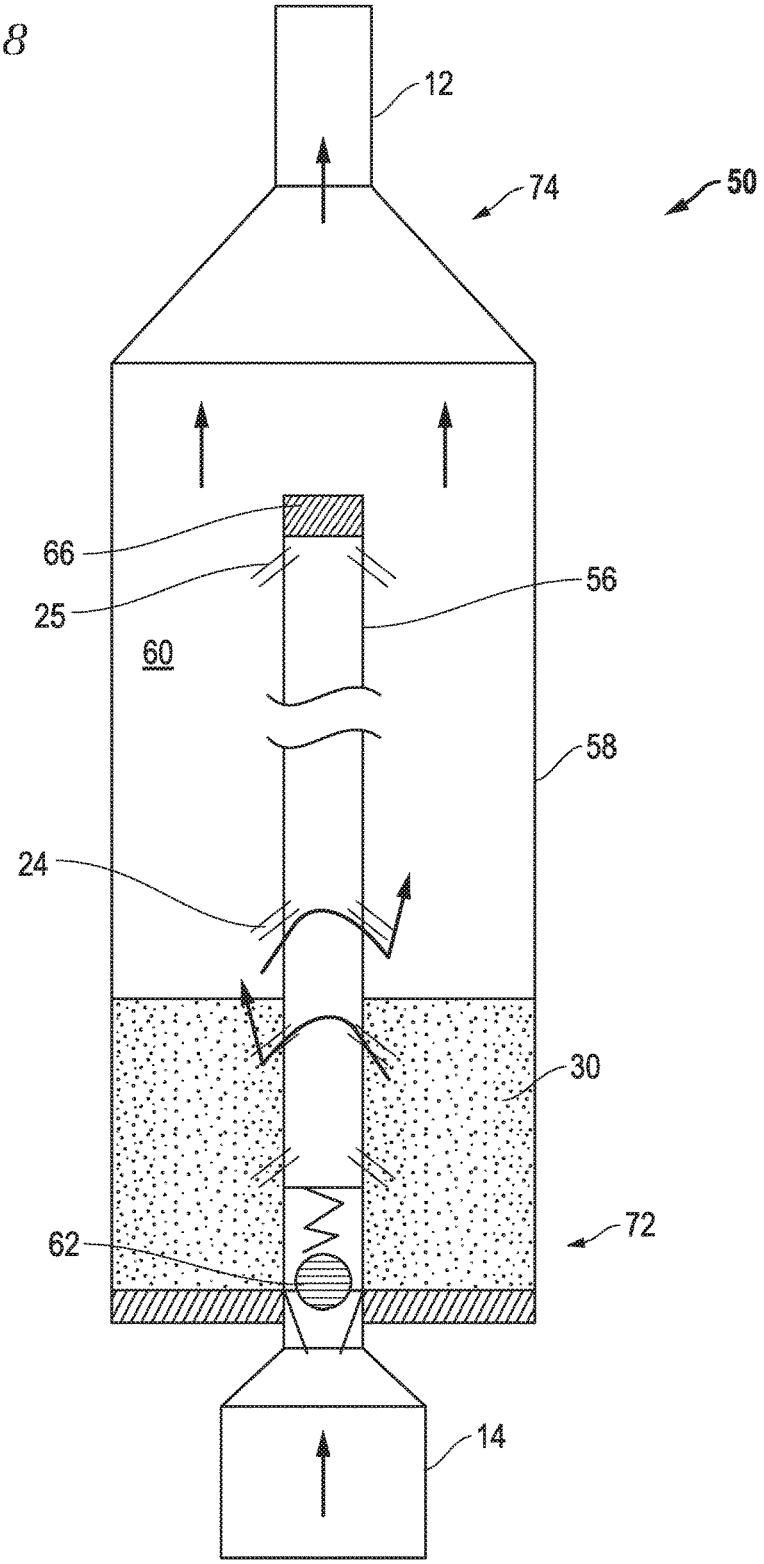
FIG. 8 is a sectional view of the device in FIG. 6 with the production fluid starting flow after having stopped.
Figure 9:
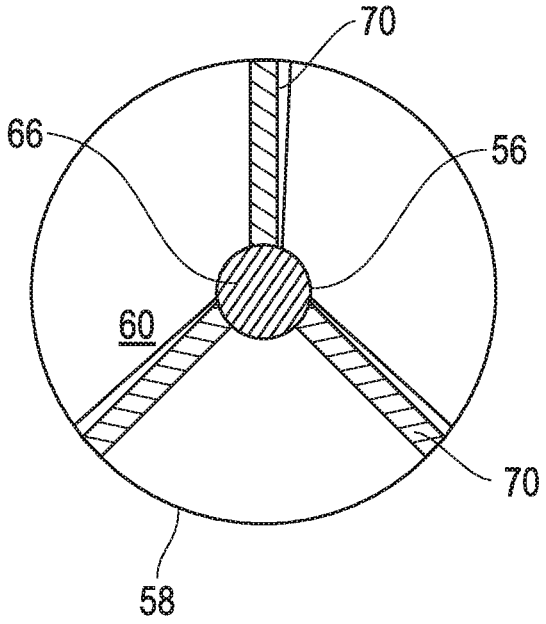
FIG. 9 is a cross section view of the device in FIG. 6 taken as shown.

In FIGS. 7-9 the same components as FIG. 6 are generally illustrated at various stages of the well operation. In FIG. 7, the ESP is off and production fluid flow has ceased. Therefore, particles such as sand 30 settle downward in the annulus 60. The check valve 62 is closed and movement of the sand entrained in the fluid is illustrated by the down arrows. Cap 66 prevents particle flow into the tube 56. Particles 30 tends to build up in the annulus 60 near the lower check valve 62, but does not appreciably flow into the tube 56 through the ports 24; the design and orientation of the ports 24 prevent sand to flow into the tube 16 (see FIGS. 4-5).

Advantageously, the fluid in the production tubing is retained while the ESP is off in FIG. 7. This allows an almost immediate restart of the ESP and quick return to normal operation (FIG. 6) and production rates. Refilling the production tubing with fluid upon restart of the ESP requires fluid equalization in the tubing and annulus and operation of the ESP in downthrust mode. Repeated startup of the ESP and operation in downthrust mode contributes to shortened ESP runlife.

The check valve 62 is largely free from impingement by sand 30 during all phases of operation of the device 50. The check valve 62 in FIG. 7, with production ceased, prevents reverse flow of fluids. Such reverse flow would occur through the ESP 14 until hydrostatic equilibrium is achieved between the production tubing and the wellbore. This reverse flow is undesirable because it can cause the ESP 14 to turn in the reverse direction compared to normal operation. The ESP cannot be restarted when it is 'back spinning' (turning in a reverse direction)—a period that can sometimes extend for a number of hours. This back spinning causes the operator to wait until he is reasonably assured that the ESP 14 is stationary before attempting to restart the ESP 14. The distal check valve 62 stops reverse flow, and therefore alleviates this "back spinning" problem.

In FIG. 8, the ESP 14 is turned on (restarted) and there are no significant buildup of particles 30 on top of the ESP discharge, i.e. ports 24 in the tube 56. The check valve 62 immediately opens upon restart of ESP 14 and production fluid flow through the tube 56 up the production tubing 12 to the surface begins almost immediately. As shown in FIG. 8, a number of the ports 24 are not covered by particles 30 and the fluid in the tube 16 flows through the ports 24 into the annulus 60. The particles 30 cover some of the lower ports 24 (e.g., ports 24 near the lower check valve 62) and little fluid flow occurs through these lower ports 24. However, the density of the particles 30 in the fluid in the annulus decreases towards the surface, allowing some fluid flow through the ports 24 into the annulus 60. This allows the annulus to be self-clearing. That is, with some ports 24 in the region of distal end 72 uncovered or partially uncovered with particles 30, fluid flows from the tube 56 through the ports 24 into the annulus 60 helping to clear the remaining sand.

In the case where sand covers substantially all of the ports 24 in the region of the distal end 72, the few ports 24 in the region of the proximal end 74 are substantially clear. Restart of ESP 14 in this case causes a pressure differential build-up between the distal and proximal ends 72, 74. In this case, the entire column of sand 30 in the annulus 60 clears through the production tubing 12 almost immediately. In this case, having a large number of ports 24 near the distal end widely spaced from a few ports 24 at the proximal end is advantageous.

FIG. 9 is a cross sections of the device 50 as shown in FIG. 6. In FIG. 9, the ESP 14 is operating (e.g., as in FIG. 6) and fluid has traversed from the tube 56 through ports 24 into the annulus 60. Centralizers 70 end to maintain the position of the tube 56 central in the housing 58.

Figure 10:
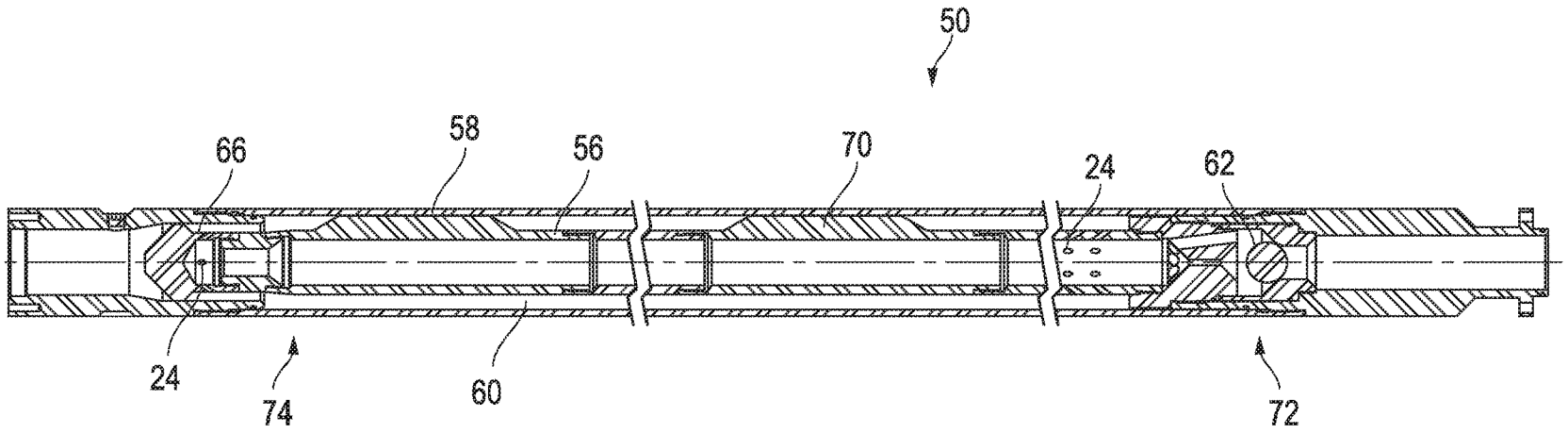
FIG. 10 is a side elevational view of an exemplary operational embodiment of a device in accordance with the present invention.

FIG. 10 illustrates an exemplary operational embodiment of the device 50 illustrated schematically in FIGS. 6-9. For comparison purposes, like numerals are applied to like components. Generally, end cap 66 is positioned at the proximal end 74 of tube 56. A few ports 24 are arranged near the end cap 66 to permit fluid flow between the tube 56 and annulus 60. Centralizers 70 maintain the position of tube 56 in the housing 58. The check valve 62 is located near the distal end 72. A large number of ports 24 are positioned through the tube 56 near the distal end 72.

While the devices 10, 50 are illustrated in the context of a vertical well bore in the figures, it will be understood that horizontal wells can benefit from the use of the devices 10, 50. In fact, horizontal wells make extensive use of proppants for fracking which is a prime contributor to particles in the production tubing which can settle onto an ESP and hinder operation. Additionally, while protection and efficient operation of an ESP are prime uses of the devices 10, 50, other downhole equipment can be protected from particle interference as well.

What is claimed is:

1. A device for preventing particle interference with downhole lifting equipment in a well bore having a production tubing string, comprising:

an elongated tube positioned between the downhole lifting equipment and the surface and in fluid communication with the lifting equipment and the production tubing string, said tube comprising a proximal uphole end and a distal downhole end, with a stationary cap at the uphole end;

a housing positioned around the tube defining an annulus portion between the tube and housing;

a check valve proximate the distal end of the tube operable to permit fluid flow upward into the tube and to inhibit fluid from flowing downward through the device;

a plurality of ports positioned in the wall of the tube operable to permit fluid flow and the passage of entrained solid particles from the tube into the annulus during upward flow of fluid and operable to inhibit particles from entering the tube when upward flow is absent, wherein the ports are spaced along the tube and oriented at an acute angle to the longitudinal axis of the elongated tube relative to the distal end.

2. The device of claim 1, wherein the ports are at an acute angle between 30-60° relative to the wall of the tube.

3. The device of claim 1, wherein the largest number of ports are positioned nearest the distal end.

4. The device of claim 3, wherein the fewest number of ports are positioned nearest the proximal end.

5. The device of claim 1, wherein the ports have an angle and size that, along with the given thickness of the tube, inhibit particles from movement into the tube when upward flow through the device is absent.

6. A method of operating lifting equipment in a well bore comprising:

positioning the lifting equipment in the well bore downhole from the surface and operable to pump fluid through a production tubing string to the surface;

connecting a particle inhibiting device to the production tubing string between the lifting equipment and the surface, the device having an outer housing, a central tubular portion with a stationary cap at the uphole end, a surrounding annulus portion between the central tubular portion and the outer housing, a plurality of spaced ports communicating between the annulus portion and the central tubular portion, the ports being spaced along the central tubular portion, sized to permit the passage of entrained solid particles during upward fluid flow, and oriented at an acute angle relative to the longitudinal axis of the housing, and a check valve operable to allow upward flow from the lifting equipment and to inhibit fluid flow downward through the device when the lifting equipment is not operating;

operating the lifting equipment to flow fluid upward through the check valve into the tubular portion through the ports into the annulus portion and into the production tubing; and ceasing operation of the lifting equipment.

7. The method of claim 6, wherein the ports are more dense closest to the downhole distal end of the central tubular portion.

8. The method of claim 6, further comprising resuming operation of the lifting equipment.

9. A system for preventing particle interference in a well bore having a production tubing string, comprising:

lifting equipment; and a device positioned between the downhole lifting equipment and the surface and in fluid communication with the lifting equipment and the production tubing string, said device comprising:

an elongated tube comprising a proximal uphole end and a distal downhole end, with a stationary cap at the uphole end;

a housing positioned around the tube defining an annulus portion between the tube and housing;

a check valve proximate the distal end of the tube operable to permit fluid flow upward into the tube and to inhibit fluid from flowing downward through the device;

a plurality of ports positioned in the wall of the tube operable to permit fluid flow and the passage of entrained solid particles from the tube into the annulus during upward flow of fluid and operable to inhibit particles from entering the tube when upward flow is absent, wherein the ports are spaced along the tube and oriented at an acute angle to the longitudinal axis of the elongated tube relative to the distal end.

10. The system of claim 9, wherein the lifting equipment comprises an electric submersible pump (ESP).

* * * * *